US005100016A

United States Patent [19]

Wischusen, III

[11] Patent Number: 5,100,016

[45] Date of Patent: Mar. 31, 1992

[54] INSULATING BLANKET FOR SHIPPING CONTAINER

[75] Inventor: Henry Wischusen, III, Lilburn, Ga.

[73] Assignee: Rock-Tenn Company, Norcross, Ga.

[21] Appl. No.: 638,078

[22] Filed: Jan. 7, 1991

Related U.S. Application Data

[63] Continuation-in-part of Ser. No. 449,597, Dec. 12, 1989, Pat. No. 5,050,794.

[51] Int. Cl.[5] ..... B65D 5/60

[52] U.S. Cl. ..... 220/403; 220/410; 229/DIG. 4; 428/76; 428/167

[58] Field of Search ..... 220/400, 403, 408, 410, 220/429, 470; 428/76, 167; 206/521, 523, 594; 383/4, 110, 120; 229/23 R, 3.1, DIG. 4

[56] References Cited

U.S. PATENT DOCUMENTS

| | | | |
|---|---|---|---|
| 2,960,136 | 11/1960 | Ziff | 383/110 |
| 3,024,935 | 3/1962 | Vinick | 206/594 |
| 3,295,643 | 1/1967 | Peterson et al. | 383/120 |
| 3,356,092 | 12/1967 | Joa | 428/167 |
| 3,879,775 | 4/1975 | Iwata | 383/4 |
| 3,890,762 | 6/1975 | Ernst et al. | 220/400 |
| 4,528,228 | 7/1985 | Clevenger | 428/76 |
| 4,685,610 | 8/1987 | Carter et al. | 229/23 R |
| 4,730,748 | 3/1988 | Bane | 220/400 |
| 4,928,847 | 5/1990 | Hollander et al. | 220/410 |
| 4,985,106 | 1/1991 | Nelson | 428/76 |

FOREIGN PATENT DOCUMENTS

| | | | |
|---|---|---|---|
| 109890 | 5/1984 | European Pat. Off. | 220/3.1 |
| 4418468 | 8/1969 | Japan | 229/DIG. 4 |
| 9018668-5 | 8/1990 | United Kingdom . | |

OTHER PUBLICATIONS

Wiley Encyclopedia of Packaging Technology, John Wiley & Sons (1986), pp. 346, 347.

U.S. Pat Appln. 07/644,033 (filed 1/22/91).

U.S. Pat Appln. 07/638,343 (filed 1/7/91).

*Primary Examiner*—Gary E. Elkins

*Attorney, Agent, or Firm*—Jones, Askew & Lunsford

[57] ABSTRACT

Insulation material is configured to provide improved insulating properties in a shipping container. An insulated bottom section is placed along the bottom of a container under the contents of the container. An insulating blanket constructed of plastic sheets sealed to form pouches for containing paperboard and mineral wool is configured to have an inverted U-shape and is placed over a bottom half of the container. A top half of the container is then placed over the bottom half such that the legs of the inverted U-shaped material are between the overlapping sides of top and bottom of the container and the middle portion of the U-shaped material is between the top of the container and the contents within the container.

28 Claims, 4 Drawing Sheets

101
12
14
16
20
22
30
32
40
42
44
50
52
54
60
62
64
66
70
72
74
76
77
78
80
84

INSULATING BLANKET FOR SHIPPING CONTAINER

CROSS REFERENCE TO RELATED APPLICATION

This is a continuation-in-part, of application Ser. No. 07/449,597, filed Dec. 12, 1989, issued Sept. 24, 1991, now U.S. Pat. No. 5,050,794.

TECHNICAL FIELD

The present invention relates to insulated containers, and more particularly relates to a tamper proof shipping container having insulation material configured to provide for improved temperature maintenance of items placed within the container.

BACKGROUND ART

Fresh and frozen food items are shipped worldwide by food suppliers. The fishing industry is one food supplier which ships tremendous quantities of fresh and frozen fish. The fish are often shipped from remote locations in areas such as Alaska to virtually every corner of the world. To preserve the quality of the fish, great care must be taken to avoid spoilage. Warm temperature contributes greatly to spoilage. Salmon in particular is one delicacy which must be handled with great care to preserve its delicate flavor. Thus, in shipping salmon, it is important to maintain frozen fish at a temperature at or below 32° F. and fresh fish at a temperature of between 33° F. and 38° F. It is also important to prevent the fish from either drying out or sitting in water.

Fish are shipped in many types of containers. Many such containers utilize corrugated paperboard in their construction. One version provides a layer of metallized plastic film adhered to the corrugated paperboard. These containers are usually configured to have a top half placed over a bottom half. To help maintain the desired temperature within the container, it is typical for refrigerants such as dry ice or reusable ice packs to be placed within the container. However, even the use of these refrigerants does not consistently maintain the temperature within conventional containers for extended periods of time, such as up to six days under the unrefrigerated conditions often encountered during shipment.

In conventional containers, temperature change is generally attributable to conductive heat transfer between the inner and outer panels of the container, convective air flow into and out of the container, conduction due to condensation formed as the result of ambient air entering the container and contacting the cooler air within the container, and radiant heat transfer. For example, when shipping cold contents, air circulation between the inside of the container and the outside of the container is detrimental to temperature maintenance. Conduction between the inner panels and the outer panels of the container and from condensation can also cause temperature change. In addition to warming both the air and the contents within the container, condensation wets the container material and weakens its structural integrity, degrades the contents, and leaks from the container. Leakage from the container is highly undesirable to air carriers, because the leakage often contains substances corrosive to the airplane. For example, in addition to mess and damage from condensation which is primarily water, the water can also mix with the contents, including salt, blood, and fish slime, to create a highly offensive and corrosive ooze.

It has been suggested to wrap the contents within the container in insulation, such as insulation consisting of mineral wool and paperboard glued together and then glued between a pair of plastic sheets, or to otherwise place insulation within the container to maintain the temperature within the container. This, however, does not inhibit conduction between panels or prevent air from passing into and out of the container. One packaging method uses tape, glue or the like to seal the container such that air is prevented from entering or exiting the container. This, however, does not inhibit conduction between the panels of the container and detracts from the container's ability to be reused. It is also known to provide a metallic or reflective finish on containers to reduce radiant heat transfer. However, these metallic finishes can promote conductive heat transfer if surfaces having a metallic finish are placed in close proximity to other surfaces having a metallic finish.

Thus, there is a need in the art for an improved method for insulating shipping containers and for an improved, reusable insulated shipping container which inhibits the passage of air into and out of the container, inhibits the formation of condensation within the container, prevents liquids from entering into or escaping from the container, decreases conduction between panels of the container, and reduces radiant heat transfer.

SUMMARY OF THE INVENTION

The present invention advances the art by providing an insulated shipping container having improved ability to maintain the temperature of items placed within the container. The present invention minimizes heat transfer by minimizing air and fluid flow between the interior and exterior of the container, by minimizing conduction between components of the container, by reducing the formation of condensation, and by reducing radiant heat transfer.

Generally described, the present invention provides an insulating material comprising a pair of liner sheets secured to one another around their periphery and at intervals across the liner sheets to define a plurality of pouches; and an insulator positioned within each of the pouches.

More particularly, the present invention provides an insulated container having a bottom tray, comprising a bottom panel having an upwardly facing inner surface and at least two bottom side panels extending upwardly from the bottom panel, each bottom side panel having an outwardly facing surface; a top cover comprising a top panel having a downwardly facing inner surface, and at least two top side panels extending downwardly from the top panel, each top side panel having an inwardly facing surface, the top cover being positioned over the bottom tray such that each inwardly facing surface of the top side panels overlaps and faces one of the outwardly facing surfaces of the bottom side panels, the overlap of the inwardly and the outwardly facing surfaces defining a pair of channels; and an insulating barrier positioned between the channels and below the inner surface of the top panel, the barrier comprising two end sections positioned within the channels, and a middle section positioned between the end sections and between the top panel and the interior of the bottom tray, the barrier comprising a pair of liner sheets secured to one another around their periphery and along seams positioned to define the end sections and the middle section so as to define pouches, and an insulator positioned within each of the pouches.

According to a preferred embodiment, the present invention provides an insulated container comprising a bottom tray having at least two bottom side panels; a U-shaped insulating barrier positioned to lie over the bottom tray and along the bottom side panel, the barrier comprising a pair of plastic sheets having a thickness of between about 1 and 4 mil secured to one another around their periphery and at intervals across the sheets to define three pouches; a sheet of paperboard having a thickness of between about 6 and 30 mil positioned within each of the pouches, and a piece of mineral wool having a density of between 2.5 and 6.0 pounds per cubic foot and a thickness of between ¼ and 1 and ¼ inch positioned within each of the pouches.

Thus, it is an object of the present invention to provide an insulating barrier.

It is another object of the present invention to provide an insulated shipping container.

It is still another object of the present invention to provide an insulated shipping container which minimizes heat transfer by minimizing air and fluid flow between the interior and exterior of the container, by minimizing conduction between components of the container, by reducing the formation of condensation, and by reducing radiant heat transfer.

It is yet another object of the present invention to provide an insulated shipping container having a U-shaped blanket, having interconnected insulated pouches positioned between channels formed by overlapping side panels.

Other objects, features, and advantages of the present invention will become apparent upon reading the following specification when taken in conjunction with the drawings and appended claims.

DETAILED DESCRIPTION OF PREFERRED EMBODIMENTS

Figure 1:
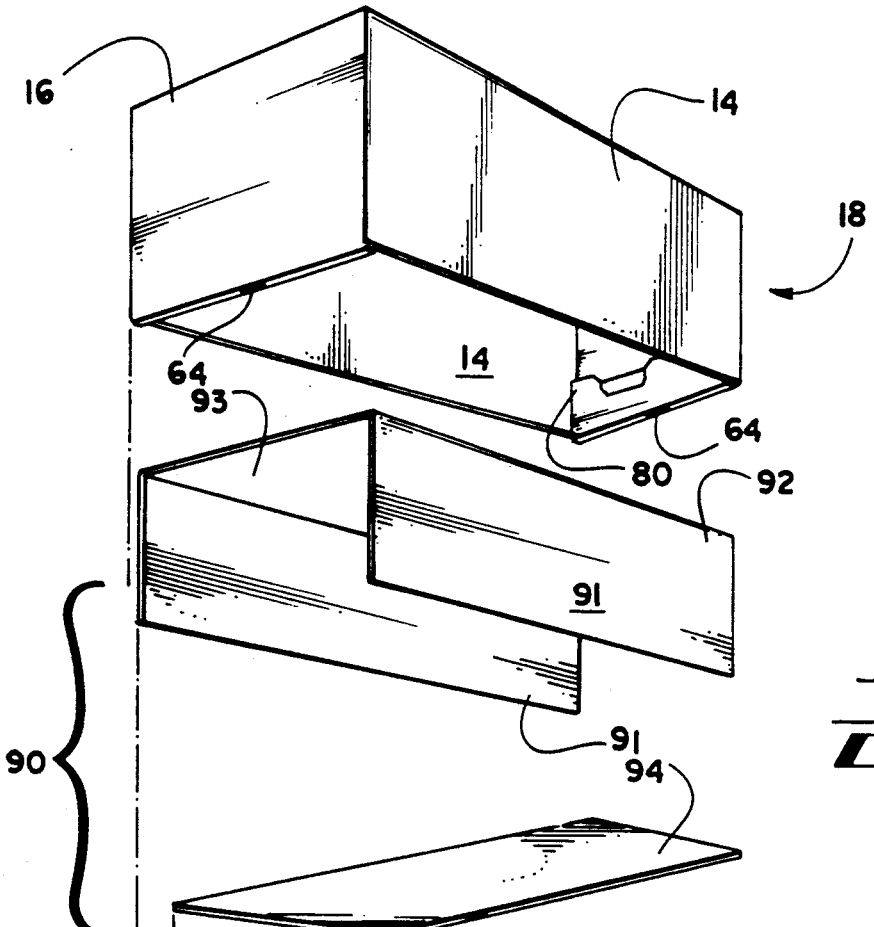
FIG. 1 is a pictorial exploded view of a preferred embodiment of an insulated container according to the invention.

Referring now in more detail to the drawings, in which like numerals refer to like parts through the several views, FIG. 1 is an exploded view of an insulated container 10. The container 10 includes a bottom tray 11, a cover 81, and a two-piece insulating barrier 90 having an interior pouch 94 and a U-shaped blanket 92.

BOTTOM TRAY AND COVER

Figure 6:
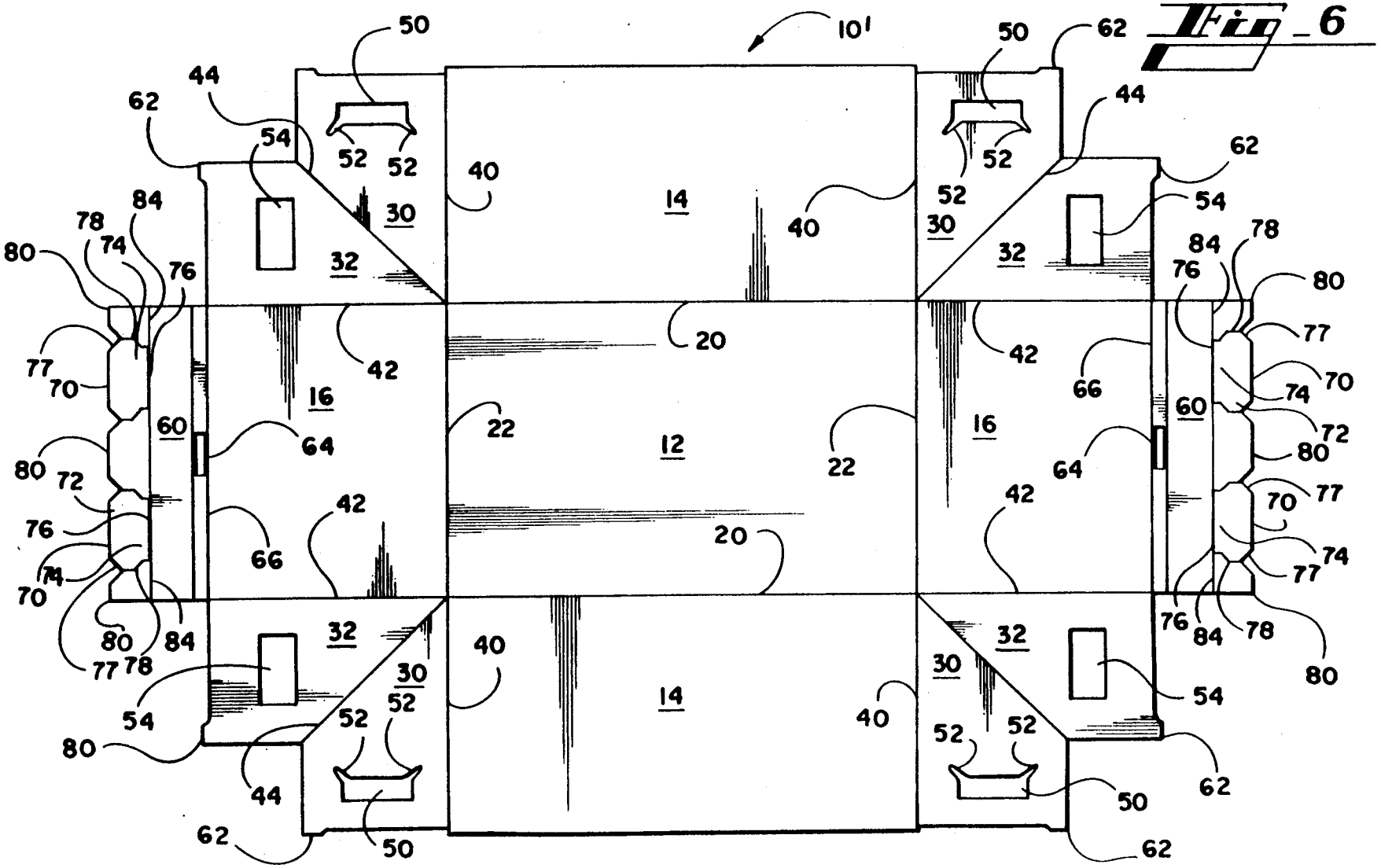
FIG. 6 is a top plan view of a blank used to construct the bottom tray and cover of a preferred embodiment of the invention.

The bottom tray 11 and the cover 81 are preferably constructed such that the assembled container 10 remains assembled independent of secondary securing devices such as tape, glue or twine. The preferred construction of the bottom tray and cover is shown in U.S. patent application Ser. No. 449,597, filed Dec. 12, 1989. Referring to FIG. 6, the bottom tray is preferably assembled using a blank 11'. In this preferred construction, the bottom tray 11 includes a bottom panel 12 in thecenter of the blank 11'. A pair of side panels 14 are foldably connected to opposite sides of the bottom panel 12 along scores or fold lines 20. A pair of end panels 16 are foldably connected to the other opposite sides of the bottom panel 12 along scroes 22. A connecting panel 30 is foldably connected along each of a plurality of scores 40 to each end of each of the side panels 14. An additional connecting panel 32 is foldably connected along each of a plurality of scores 42 to each end of each of the end panels 16. Each connecting panel 30 is foldably connected along scores 44 to the connecting panel 32 adjacent to each of the connecting panels 30. A retention tab 62 extends upwardly from each upper edge of the connecting panels 30 and 32 and extends into a retention opening 64 as described below.

Each of the connecting panels 30 defines a first opening 50 therethrough into which a locking tab 70, described below, is inserted. To help each locking tab 70 enter into and be secured within each first opening 50, the first opening 50 is preferably rectangular in shape and defines angled slots 52 extending from the lower corners of the rectangle. Each of the connecting panels 32 defines a second opening 54 therethrough, at least partly overlapping the first opening 50 when the tray 11 is erected. Each second opening 54 is preferably rectangular in shape to provide clearance to help the locking tab 70 slide into the first opening 50.

Extending upwardly from and foldably connected along scores 66 to the upwardly extending edges of each of the end panels 17 is a retention panel 60. Each retention panel 60 is shaped to cover, when the tray 11 is erected, the area of each connecting panel 30 which extends upwardly from the first opening 50 to the upper edge of the connecting panel 30. Each retention panel 60 defines a pair of locking tabs 70, which are slidably inserted into the first openings 50. The locking tabs 70 each have a head portion 72 extending outwardly from a neck portion 74, with the neck portion 74 foldably connected to the outermost horizontal edge of the retention panels 60, along scores 76. The head portion 72 of each locking tab 70 is wider than the first openings 50 and has a plurality of bevelled corners 77 positioned to pass into the slots 52. The head portion 72 also defines a plurality of angled edges 78 positioned to be trapped by the slots 52 when the head portion 72 is inserted into the first opening 50. Each of the scores 66 defines a retention opening 64 along a portion of each of the scores 64, into which the retention tabs 62 extend.

Extending from the retention panels 60 and located adjacent to the locking tabs 70 are tamper tabs 80, positioned so that an unexposed surface 82 of each of the tamper tabs 80, faces each of the connecting panels 30 when the tray 11 is erected. The tamper tabs 80 are foldably connected to the retention panels 60 along scores 84.

To assemble the blank 11' into the tray 11, the side panels 14 may be raised relative to the bottom panel 12 by folding about the scores 20. Simultaneously, folds may be made about the scores 22, 40, 42 and 44, raising the connecting panels 30 and 32 and the end panels 16, respectively. As will be apparent to one skilled in the art, folding about the scores 40 and 42 may be made to orientate the connecting panels 30 and 32 either within or exterior to the raised side panels 14 and end panel 16. The connecting panels 30 and 32 may be folded about the scores 46 such that each connecting panel 32 is parallel to and in contact with either the exterior or interior face of each end panel 16. When the connecting panels are positioned exterior to the end panel 16, one face of the connecting panel 30 is parallel to and in contact with the connecting panel 32 and the other face of the connecting panel 30 is exposed. The same folding action brings the retention tabs 62 on adjacent panels 30 and 32 into alignment.

It will be seen that the tray 11 may be formed using locking tabs as described above while utilizing only connecting panels 30, or only connecting panels 32, or a combination thereof. It will further be seen that connecting panels 30 and 32 are not required to be foldably connected along scores 44.

To form the tray 11 the connecting panels are folded exterior to the side and end panels. Then the adjacent connecting panels are folded toward the end panels 16. The connecting panels 32 are then oriented parallel to and in contact with the exterior face of each end panel 16. The retention panels 60 may then be folded about the scores 66 downwards against the connecting panels 30 and 32 with the aligned pairs of retention tabs 62 contained within the retention openings 64. When the retention panels 60 are folded against the connecting panels 30 and 32, the head portion 72 of the locking tabs 70 may be inserted into the first opening 50, so that the bevelled corners 76 pass through the slots 52, and the edges 78 lock in the slots 52. The second opening 54 provides clearance to help the head portion 72 slide into the first opening 50. When fully inserted the locking tabs 70 will remain locked in the slots 52 unless the tabs are manipulated intentionally to allow them to pass back through the slots, which may be done to disassemble the container. When all four locking tabs 70 are inserted into the slots 52, the tray is erected and ready for loading. This locking arrangement not only maintains closure, but also provides a leak proof tray by utilizing seamless construction. The tray 11 may be repeatedly disassembled and assembled.

As will be apparent to one skilled in the art, the retention panels 60 may alternatively be foldably connected to the side panels 14 and the connecting panels 30 and 32 may be folded against the side panels, so that the retention panels fold down over the side panels to allow insertion of the locking tabs 70.

Figure 2:
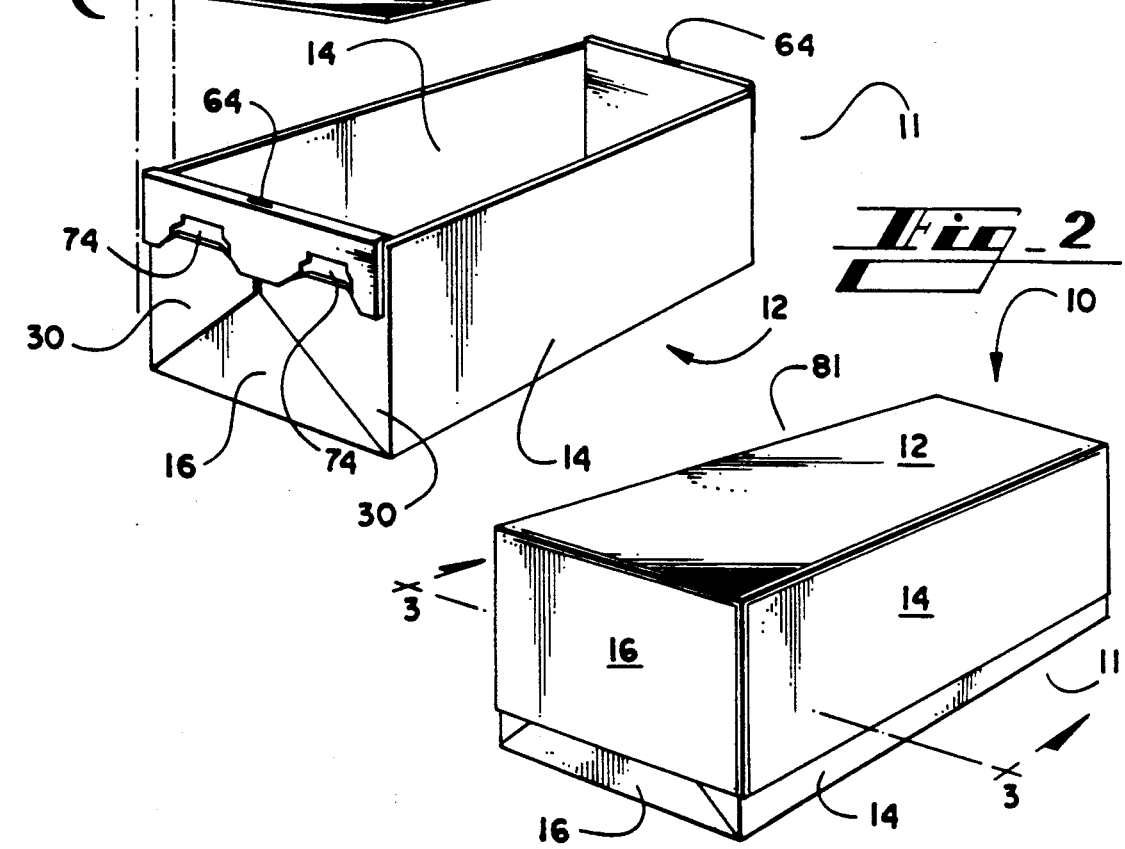
FIG. 2 is a pictorial view of a preferred embodiment of an enclosed insulated container according to the invention.

As previously explained, the connecting panels 30 and 32 may be folded against either the interior or exterior of the end panels 16. A container cover 81 shown in FIG. 1 formed in the same manner as the tray 11, is made by positioning the connecting flaps 30 and 32 interior to the side and end panels. The cover 81 may then be placed over the tray 11 and the insulating barrier 90 to form an enclosed container 10 as is shown in FIG. 2, and explained further below. The above steps may be reversed when disassembly is required, with the unassembled blanks being space efficient and readily reassembled.

It is also desirable that a metallized plastic film or foil/plastic laminate layer be disposed on the exterior and interior surfaces of the paperboard blank 11', as is well known in the art. Preferably the plastic surface is positioned to the exterior of the metal layer. However, to avoid metal-to-metal proximity which readily conducts heat between the adjacent components, the metallized layer preferably is not provided for surfaces of the container which immediately abut other similarly prepared surfaces of the container. For example, metallization may be omitted from the inner top sidewall panels and the outer bottom sidewall panels when a metallized blanket (described below) is utilized.

INSULATING BARRIER

Referring to FIG. 1., the preferred two-part insulating barrier 90 includes the blanket 92 comprised of two end sections or pouches 91 attached to a middle section or pouch 93, and the one-piece interior pouch 94. While it is preferred to include the interior pouch 94, the improved thermal integrity of the insulated container 10 is due primarily to the ability of the blanket 92 to minimize conductive and convective heat transfer, as discused below.

To install the insulating barrier 90, the interior pouch 94 is placed inside the tray 11 along the bottom panel 12. The blanket 92 is then placed over and around the tray 11, so that the exterior surfaces of the bottom side panels 14 face a side of the U-shaped blanket, as will be discussed further. To form the enclosed container 10, the cover 81 is positioned over the thus assembled tray 11 and insulating barrier 90 such that each outwardly facing surface of the blanket 92 faces an interior surface of the cover 81 and is positioned within a pair of channels 112 defined between these facing surfaces, as shown in FIG. 3.

Turning to the construction of the barrier 90, the two embodiments below provide examples of insulation materials suitable for many purposes. The below descriptions refer to the construction of embodiments of the blanket 92. It will be understood, however, that similar embodiments of the pouch 94 may be constructed and placed along the bottom of the tray 11 to complete the barrier 90 and provide additional insulation.

Figure 3:
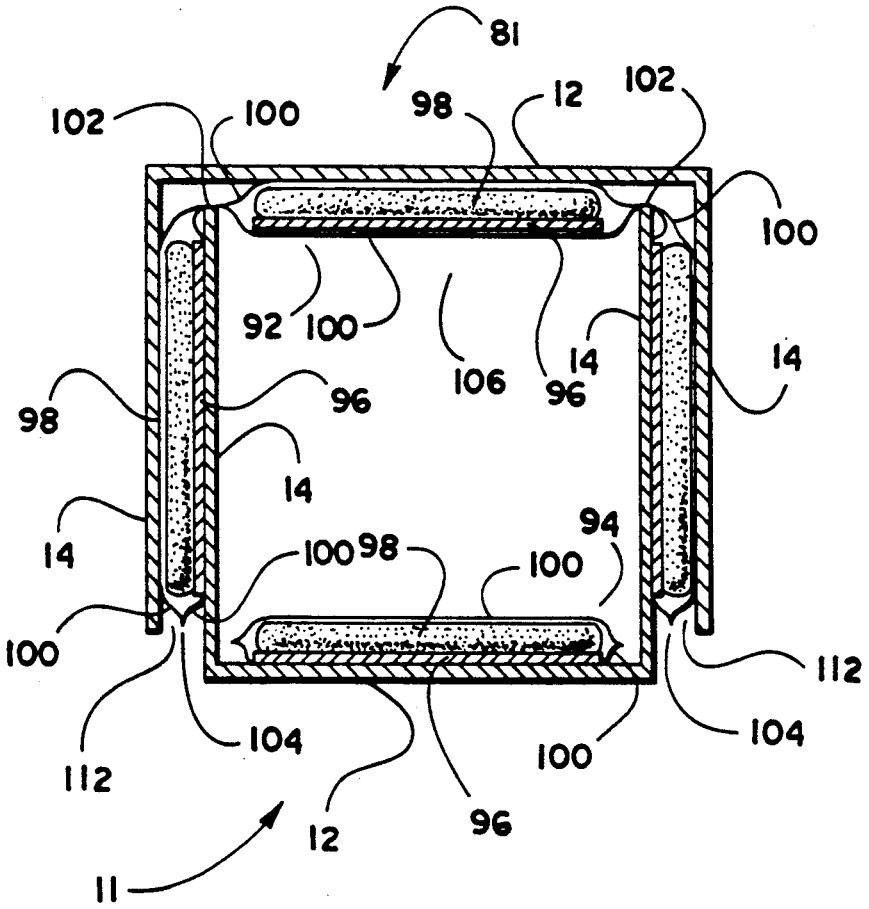
FIG. 3 is a horizontal cross-sectional view of the insulated container taken along line 3—3 of FIG. 2, showing the position of a preferred embodiment of the insulating barrier in the enclosed container of the present invention.
Figure 4:
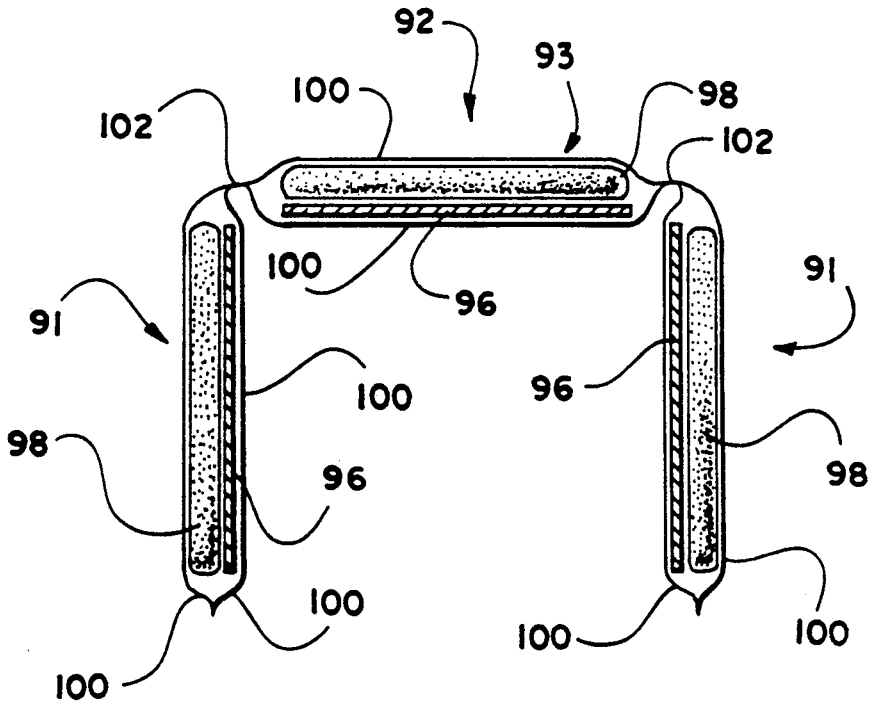
FIG. 4 is a horizontal cross-sectional view showing the construction of a preferred embodiment of the insulating blanket.

Referring to FIG. 3, there is shown a preferred embodiment of the blanket 92 installed to form the container 10. The blanket 92, shown also in FIG. 4, is a U-shaped blanket preferably constructed by sandwiching three sheets of a stiffener 96 and three sheets of an insulator 98 between a pair of plastic sheets 100. The plastic sheets 100 are sealed around their periphery and along a pair of seams 102, preferably by heat sealing or use of an adhesive, to form the end pouches 91 and the middle pouch 93. A set consisting of one sheet of the stiffener 96 and one sheet of the insulator 98 is inserted into each of the pouches prior to enclosure of the pouches. Preferred construction materials are shown in Table 1:

TABLE 1

| Component | Material |
|---|---|
| Stiffener | Paperboard having a thickness of between about 6 and 30 mil (between about 6 and 30 point chip board). |
| Insulator | Mineral wool, having a density of between 2.5 and 6.0 pounds per cubic foot and a thickness of between ¼ and 1 and ¼ inch. |
| Plastic sheets | Polyethylene, having a thickness of between 1 and 4 mil; coated with a reflective finish on the exterior surfaces, such as aluminum having a |

TABLE 1-continued

| Component | Material |
|---|---|
| | thickness of between 90 and 110 Angstroms applied using a standard technique such as vacuum deposition. |

The seams 102 are sealed seams which prevent air from passing from one pouch to another and thereby reduces convective heat transfer between pouches. Additionally because the individual sheets of stiffener 96 and insulator 98 are not continuous between the pouches 91 and 93 of the blanket 92, heat does not conduct directly through the stiffener and insulator of one pouch to the stiffener and insulator of another pouch. The stiffener 96 makes a smaller contribution to the insulation properties of the blanket 92 than does the insulator 98, adding primarily to the puncture resistance of the blanket and serving to more evenly distribute weight to prevent point compression of the insulator 98. Additionally, each stiffener may be glued to each insulator, preferably with edible, fast drying, water soluble glues, to improve handling qualities. To further enhance insulating qualities, it will also be understood that a metallic or reflective finish may be provided on the surfaces of the blanket 92, such as by vacuum deposition, to reduce radiant heat transfer. However, if the inner surfaces of the tray 11 and cover 81 are metallized, it is preferably not to metallize the blanket 92 in order to avoid metal-to-metal proximity.

The blanket 92 is shown positioned between the tray 11 and the cover 81, such that the blanket 92 covers the top of the tray 11 and extends into channels 112 formed by the side panels 14 when the cover 81 is placed over the tray 11. Thus, the blanket 92 should be configured to conform closely to the top of the tray 11 and to be pressed between the panels 14 in the channels 112. The sheet 92 of corrugated board is shown positioned along the bottom of the tray 11 to complete the barrier and provide additional insulation.

As shown in FIG. 3, the blanket 92 is somewhat bulky and substantially occupies the channels 112 and prevents the side panels 14 of the cover 81 from contacting the side panels 14 of the tray 11. In this manner, heat transfer attributable to convection and conduction are minimized.

Convection is the transfer of heat by the circulation of fluids, i.e., such as air flow through the channels 112. Conduction is the transfer of heat between two parts of a stationary system, i.e., such as between the top and bottom side panels 14, caused by a temperature difference between the interior and exterior of the container. Convection is minimized because the blanket 92 effectively blocks air flow through the channels 112 between the interior of the container 10 and the environment. The end panels 16 of the tray 11 and cover 81 are smaller than the side panels 14 and do not provide as large a channel area for convection. Additionally, because of the construction of the end panels 16, the end panels tend to press against one another to minimize air flow between them and additional insulation to protect against convective heat transfer may be omitted.

The blanket 92 also separates the side panels 14 of the tray 11 and the cover 81, and provides a barrier to heat conduction between these panels which could result because of the temperature difference between the interior and exterior of the container. Conduction through the end panels 16 is not a significant problem, primarily because of the small surface area of the end panels and because of dead air space between the end panels 16 of the tray 11 and the cover 81 created by the end construction. Because of these considerations, and to permit the preferred end construction, the end panels 16 of the container are not insulated further. It should be understood however, that the blanket 92 could be extended between the channels formed between the end panels. By minimizing convection and conduction, as described above, condensation is also discouraged from forming.

Figure 5:
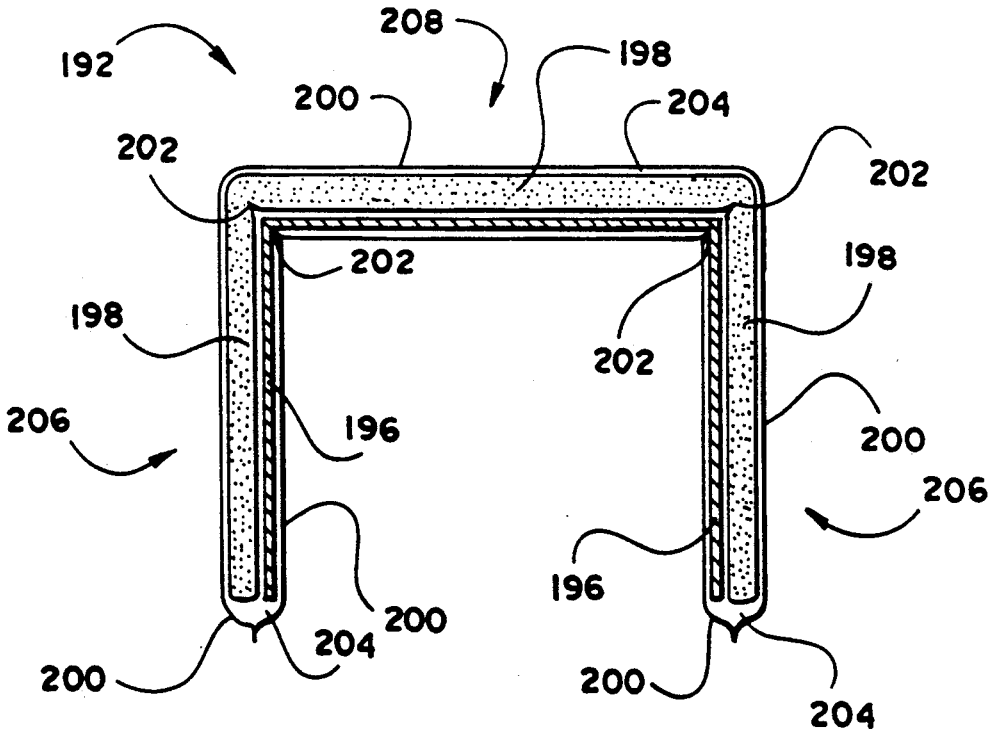
FIG. 5 is a horizontal cross-sectional view showing the construction of an alternate embodiment of the insulating blanket.

An alternate embodiment of the insulating blanket 92 is shown in FIG. 5. Referring to FIG. 5, a blanket 192 may be constructed by sandwiching a stiffener 196 and an insulator 198 between a pair of plastic sheets 200. The same materials as shown in Table 1 may be utilized except that a single sheet of the stiffener 196 and insulator 198 are utilized, with the insulator and stiffener being crushed to form scores 202. Also, the plastic sheets 200 are not adhered to one another or otherwise altered in the area of the scores 202 except for being sealed to one another along their peripheral edges. This provides a single pouch 204, with the U-shaped configuration. The scores 202 delineate the blanket into two end sections 206 and a middle section 208. Because the plastic sheets 200 are not adhered to one another along the scores 202, a vented seam 210 is provided between each end section 206 and the middle section 208. One skilled in the art will appreciate that the seams 210 are held tightly by the cover 81 along the upper edges of the bottom side panels 14 of the tray 11. This provides a tight, gasket like seal along the upper edges of the bottom side panels of the tray to provide even greater protection from convective heat transfer.

In the embodiments shown in FIGS. 4 and 5, the volume of the blankets 92 and 192 may be reduced by removing air from between the plastic sheets. Removal of the air preferably is accomplished by applying a vacuum between the plastic sheets when sealing the plastic sheets, or by compressing the mineral wool to force out trapped air when sealing the plastic sheets, and allowing the mineral wool to expand once sealing is accomplished.

The foregoing description relates to preferred embodiments of the present invention, and modifications or alterations may be made without departing from the spirit and scope of the invention as defined in the following claims.

I claim:

1. An insulated container, comprising:

(A) a bottom tray comprising:

(i) a bottom panel having an upwardly facing inner surface; and (ii) at least two bottom side panels extending upwardly from said bottom panel, each bottom side panel having an outwardly facing surface;

(B) a top cover comprising:

(i) a top panel having a downwardly facing inner surface, and (ii) at least two top side panels extending downwardly from said top panel, each top side panel having an inwardly facing surface, (iii) said top cover being positioned over said bottom tray such that each inwardly facing surface of said top side panels overlaps and faces one of said outwardly facing surfaces of said bottom side panels, the overlap of said inwardly and said outwardly facing surfaces defining a pair of channels; and (C) an insulating barrier positioned between said channels and below said inner surface of said top panel, comprising two end sections positioned within said channels, and a middle section positioned between said end sections and between said top panel and the interior of said bottom tray, said barrier comprising, (i) a pair of liner sheets secured to one another around their periphery and along seams positioned to define said end sections and said middle section so as to define pouches, and (ii) an insulator positioned within each of said pouches.

2. The container of claim 1 wherein said barrier further comprises a stiffener positioned within each of said pouches.

3. The container of claim 2, wherein said barrier further comprises a bottom insulating section positioned along said inner surface of said bottom panel.

4. The container of claim 2, wherein each of said insulators is positioned between one of said stiffeners and an inner surface of one of said liner sheets.

5. The insulated container of claim 2, wherein said top cover urges said insulating barrier against upwardly facing edges of said bottom side panels.

6. The container of claim 2, wherein said insulating barrier has a reflective finish on at least one surface.

7. The container of claim 2 wherein each of said insulators is mineral wool.

8. The container of claim 2, wherein each of said stiffeners is paperboard.

9. An insulated container, comprising:

(A) a bottom tray having a pair of upwardly extending bottom side panels, each of said bottom side panels defining an outwardly facing surface;

(B) an insulating barrier having a pair of end sections and a middle section, positioned to extend over the bottom tray and downwardly over said outwardly facing surfaces of said bottom tray, said barrier comprising (i) a pair of liner sheets having facing surfaces and secured to one another around their periphery and at intervals across said liner sheets to define pouches corresponding to said end sections and said middle section, (ii) a stiffener positioned within each of said pouches, and (iii) an insulator positioned within each of said pouches; and (C) a cover having a pair of downwardly extending cover side panels, each of said cover side panels defining an inwardly facing surface, said cover being positioned over said tray and barrier such that said portions of said barrier are pressed between said cover side panels and said bottom side panels.

10. An insulated container, comprising:

a bottom tray having at least two bottom side panels;

a U-shaped insulating barrier positioned to lie over said bottom tray and along said bottom side panels said barrier comprising:

(i) a pair of liner sheets having facing surfaces and secured to one another around their periphery and at intervals across said liner sheets to define pouches;

(ii) a stiffener positioned within each of said pouches, and (iii) an insulator positioned within each of said pouches; and a cover having at least two top side panels, said cover being positioned to retain said U-shaped barrier between said bottom side panels and said top side panels.

11. The container of claim 10, wherein each of said stiffeners comprises a paperboard sheet having a thickness of between about 6 and 30 mil.

12. The container of claim 11, wherein each of said insulators comprises mineral wool having a density of between 2.5 and 6.0 pounds per cubic foot and a thickness of between ¼ and 1 and ¼ inch.

13. The container of claim 12, wherein said liner sheets comprises plastic sheets having a thickness of between about 1 and 4 mil.

14. The container of claim 13, wherein said plastic sheets have a reflective finish on at least one of their outer surfaces.

15. The container of claim 14, wherein said barrier extends substantially the length and height of said bottom side panels.

16. The container of claim 10, further comprising a bottom insulating section positioned along an inner surface of said bottom tray.

17. The container of claim 16, wherein said bottom insulating section comprises:

(i) a pair of bottom liner sheets having facing surfaces and secured to one another around their periphery to define a bottom pouch, and (ii) a bottom insulator positioned within said bottom pouch.

18. The container of claim 17, further comprising a bottom stiffener positioned within said bottom pouch.

19. The container of claim 18, wherein said bottom insulating section has a reflective finish on at least one of its surfaces.

20. The container of claim 19, wherein said bottom insulating section extends over substantially all of said inner surface of said bottom tray.

21. An insulated container, comprising:

a bottom tray having at least two bottom side panels;

a U-shaped insulating barrier positioned to lie over said bottom tray and along said bottom side panels, said barrier comprising:

(i) a pair of plastic sheets having a thickness of between about 1 and 4 mil secured to one another around their periphery and at intervals across said plastic sheets to define three pouches, (ii) a sheet of paperboard having a thickness of between about 6 and 30 mil positioned within each of said pouches, and (iii) a sheet of mineral wool having a density of between 2.5 and 6.0 pounds per cubic foot and a thickness of between ¼ and 1 and ¼ inch positioned within each of said pouches.

22. An insulating container, comprising:

a bottom tray having at least two bottom side panels;

an insulating barrier positioned to lie over said bottom tray and along at least two of said bottom side panels, said barrier comprising:

(i) a pair of liner sheets having facing surfaces and secured to one another around their periphery and at intervals across said liner sheets to define at least three pouches, and (ii) an insulator positioned within each of said pouches; and a cover having at least two top side panels, said cover positioned to retain said barrier between at least two of said bottom side panels and at least two of said top side panels.

23. The container of claim 22, wherein said barrier further comprises a stiffener positioned within at least one of said pouches.

24. The container of claim 23, wherein each of said stiffeners is paperboard.

25. The container of claim 22, wherein each of said insulators is mineral wool.

26. The container of claim 25, wherein at least one of said insulators and at least one of said stiffeners are loose and unattached to said liner sheets.

27. The container of claim 22, wherein said insulating barrier has a reflective finish on at least one surface.

28. An insulating barrier for a shipping container, said barrier comprising:

(i) a pair of flexible liner sheets secured to one another around their periphery and at intervals across said liner sheets to define a plurality of pouches;

(ii) a compressible insulator loosely positioned within each of said pouches; and (iii) a stiffener loosely positioned within at least one of said pouches.

* * * * *